US005255991A

United States Patent [19]

Sparkes

[11] Patent Number: 5,255,991

[45] Date of Patent: Oct. 26, 1993

[54] LOCKABLE RING BINDER MECHANISM

[75] Inventor: Anthony H. Sparkes, Gloucestershire, England

[73] Assignee: Bensons International Systems Limited, Gloucestershire, England

[21] Appl. No.: 861,070

[22] Filed: Mar. 31, 1992

[30] Foreign Application Priority Data

Apr. 15, 1991 [GB] United Kingdom ..... 9107961

[51] Int. Cl.[5] ..... B42F 13/26

[52] U.S. Cl. ..... 402/38; 402/41

[58] Field of Search ..... 402/37, 38, 40, 41

[56] References Cited

U.S. PATENT DOCUMENTS

| | | | |
|---|---|---|---|
| Re. 18,806 | 4/1933 | Dawson | 402/38 |
| 1,787,957 | 1/1931 | Schade | 402/38 |
| 1,913,700 | 6/1933 | Dawson | 402/38 |
| 1,913,701 | 6/1933 | Dawson | 402/38 |
| 1,927,113 | 9/1933 | Dawson | 402/38 |
| 1,953,981 | 4/1934 | Trussell | 402/38 |
| 2,030,473 | 2/1936 | Schade | 402/38 |
| 2,056,812 | 10/1936 | Unger | 402/38 |
| 2,061,676 | 11/1936 | Schade | 402/38 |
| 2,105,235 | 1/1938 | Schade | 402/38 |
| 3,098,490 | 7/1963 | Wance | 402/38 |
| 3,101,719 | 8/1963 | Vernon | 402/38 |
| 3,884,586 | 5/1975 | Michaelis | 402/38 |
| 4,522,526 | 6/1985 | Lozfau | 402/37 |
| 4,571,108 | 2/1986 | Vogl | 402/38 |
| 4,722,627 | 2/1988 | Salacuse | 402/20 |
| 4,813,803 | 3/1989 | Gross | 402/38 |
| 4,830,528 | 5/1989 | Handler | 402/34 |
| 4,832,521 | 5/1989 | Handler | 402/34 |
| 4,904,103 | 2/1990 | Im | 402/35 |
| 4,919,557 | 4/1990 | Podosek | 402/41 |
| 5,018,896 | 5/1991 | Vanni | 402/38 |
| 5,067,840 | 11/1991 | Cooper et al. | 402/38 |

*Primary Examiner*—Paul A. Bell

*Attorney, Agent, or Firm*—Darby & Darby

[57] ABSTRACT

A ring binder locking mechanism has a pair of toggle blades abutting edge to edge with one another within an elongate spring housing. A booster trigger is mounted at each end of the housing for locking the blades and their half rings in a closed position. The trigger is of one-piece metal construction and includes a pair of locking arms engagable with the blades to lock them with the half rings closed.

8 Claims, 3 Drawing Sheets

LOCKABLE RING BINDER MECHANISM

BACKGROUND OF THE INVENTION

This invention relates to a ring binder mechanism of the type wherein opposed half-rings are carried on a pair of elongate blades retained in edge-to-edge relationship in a spring housing. In such a mechanism the blades carrying the half-rings are movable with a toggle action against the resilience of the spring housing between an open position, in which opposed half-rings are separated, and a closed position in which the ends of opposed half-rings abut against one another.

In such mechanisms it is known to provide a locking device engaging the blades and being operable to restrain the half-rings against opening movement from their closed position. Such a locking device may also be operable to function as a "booster" to facilitate movement of the half-rings between their open and closed positions and vice versa. Ring binder mechanisms of this type are described and illustrated in U.S. Pat. No. 1,787,957 and U.S. Pat. No. 2,030,473 wherein the locking device comprises a trigger carried on the housing and having means thereon to engage the blades. In U.S. Pat. No. 1,787,957 the trigger is pivotally mounted on the housing by means of a pivot pin whilst in U.S. Pat. No. 2,030,473 the trigger has a pivoting and sliding movement relative to the blades by means of a bifurcated pin engaging the blades.

Mechanisms constructed as aforesaid are relatively complex and therefore expensive to produce and it is an object of the present invention to provide a locking ring binder mechanism which overcomes certain at least of these disadvantages.

SUMMARY OF THE INVENTION

In accordance with one aspect of the invention there is provided a ring binder locking mechanism comprising an elongate spring housing; a pair of elongate blades extending within said housing in edge to edge relationship with one another and having their outer edges retained at opposed edges of said housing; a plurality of half-rings mounted on each blade each extending through an aperture in said housing, the half-rings on one blade co-operating with half-rings on the other blade and being movable with the blades between an open position in which the inner edges of the blades are located adjacent the housing and the ends of opposed half-rings are separated from one another and a closed position in which the inner edges of the blades are spaced from the housing and the ends of opposed half-rings are in contact with one another, the blades being movable between said open and closed positions with a toggle action against the resilience of the spring housing; locking means for securing the half-rings in said closed position comprising at least one locking trigger extending in one direction through said housing on the same side thereof as the half-rings and extending in the other direction between said blades and the housing, said trigger having laterally extending locking arms adapted to bear on the blades in their closed position, and being movable, in the closed position of the half-rings and blades, with an over-centre action between an unlocked position in which said locking arms are free between the blades and the housing and a locked position in which said locking arms bear on the blades preventing them from being moved to their said open position.

The trigger is of one-piece construction and conveniently includes an operating portion located on the same side of the housing as the half-rings, and laterally extending portions engageable with the blades on those sides thereof remote from the housing. Conveniently the ends of the blades are so configured as to define an axially extending recess through which the trigger extends in such manner that each blade is straddled by a said locking arm, on that side of the blade adjacent the housing, and a said laterally extending portion on that side of the blade remote from the housing.

The trigger is preferably retained for movement between its locked and unlocked positions within the housing by a separate retaining member located within the respective end of the housing.

BRIEF DESCRIPTION OF THE DRAWINGS

Other features of the invention will become apparent from the following description given herein solely by way of example with reference to the accompanying drawings wherein.

DESCRIPTION OF THE PREFERRED EMBODIMENTS

Figure 1:
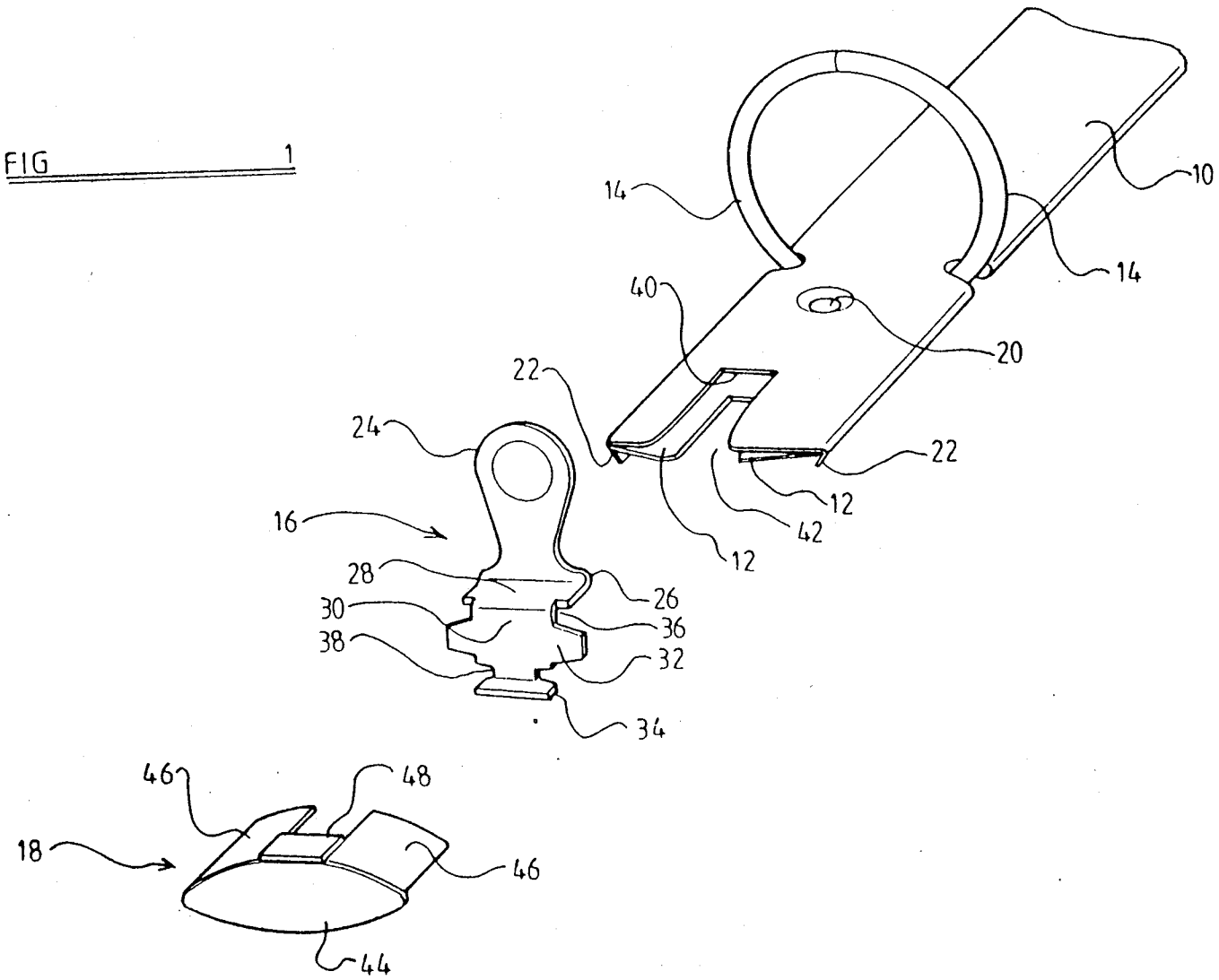
FIG. 1 is an exploded perspective view of one end of a ring binder mechanism constructed in accordance with the invention showing the locking trigger and the retaining member whereby the trigger is retained relative to the spring housing.

Referring to FIG. 1 of the drawings there is shown one end of a ring binder mechanism constructed in accordance with the invention comprising an elongate spring housing 10, a pair of elongate blades 12 retained within the housing in edge-to-edge relationship with one another, an opposed pair of half-rings 14 one of which is carried on each blade, a locking trigger 16, and a retaining member 18 locatable at the end of the housing to retain the trigger in position. It will be appreciated that the housing may be of any suitable length to fit within a loose-leaf binder for which purpose one or more rivet holes 20 are formed in the housing and in corresponding cut-out portions of the blades whereby the mechanism may be riveted to the spine of a loose-leaf binder. It will also be appreciated that any convenient number of pairs of opposed half-rings may be provided.

Figure 7:
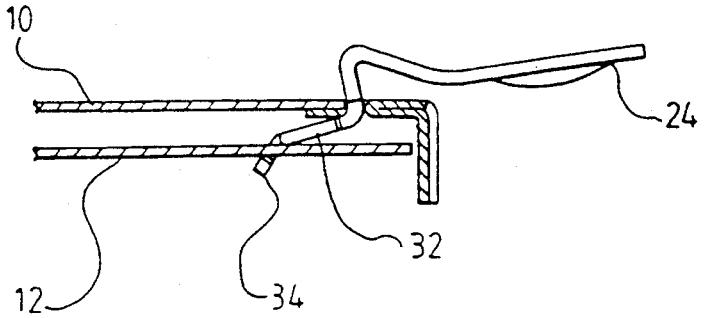
FIG. 7 is a similar longitudinal cross-sectional view but showing the blades carrying the half-rings in their open position.

As shown in FIG. 1, the housing 10 has an upper convex surface with opposed downwardly and inwardly extending edges 22 retaining the outer edges of the blades 12. The blades, carrying the half-rings 14, which extend through corresponding apertures in the housing, are movable with a toggle, or snap, action against the resilience of the spring housing 10 between the closed position shown in FIG. 1 and an open position as shown in FIG. 7. In the closed position shown in FIG. 1 the inner edges of the blades 12 are spaced from the inner surface of the housing and the ends of the opposed half-rings abut against one another whilst in the open position the inner edges of the blades lie adjacent the inner surface of the housing and the ends of the half-rings are separated whereby punched loose leaves may be inserted in or removed from the book in which the mechanism is located.

The locking trigger 16 comprises a one-piece metal fabrication having an upper operating portion 24 which at its lower end is cranked at 26 to provide an intermediate portion 28 which at its other end is cranked at 30 to extend downwardly to provide a pair of co-planar laterally extending locking arms 32 and a further pair of opposed laterally extending portions 34. Each said locking arm 32 is a mirror image of the other having an inclined upper surface and an inclined lower surface with the two surfaces being convergent in a direction outwardly of the trigger. The intermediate portion 28 is provided with a shoulder whereby a groove 36 is provided in the trigger at the cranked transition 30 between the portion 28 and the locking arms 32. A second groove 38 is defined between the locking arms 32 and the said laterally extending portions 34 of the trigger.

As can be seen from FIG. 1, the end of the housing is provided with an axially extending recess 40 and a similar recess 42 is provided at the ends of the inner edges of the blades whereby, when the trigger is assembled to the housing, the opposed edges of the recess 40 in the housing engage in the trigger groove 36 between the portion 28 and the upper surfaces of the locking arms 32, and the opposed edges of the recess 42 between the blades 12 engage in the trigger groove 38 provided between the locking arms 32 and the laterally extending portions 34 of the trigger. The recess 42 extends axially from ends of the blades 12. The recess 40 extends axially from an end of the housing 10. The trigger 12 extends through both recesses 40, 42.

Figure 2:
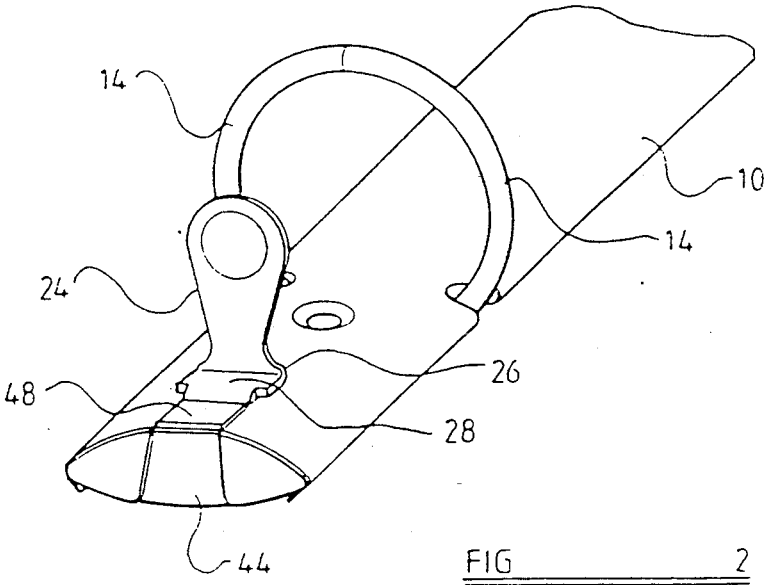
FIG. 2 is a perspective view showing the elements of FIG. 1 assembled together with the trigger in its locked position restraining the closed half-rings against opening movement.
Figure 3:
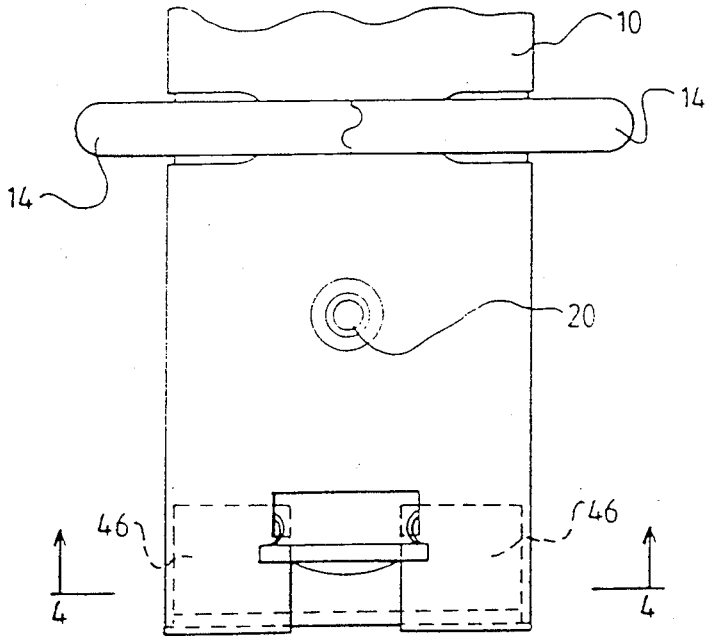
FIG. 3 is a top plan view of that end of the mechanism shown in FIGS. 1 and 2.
Figure 4:
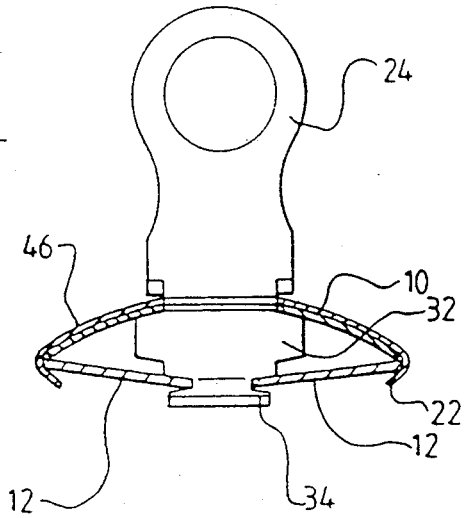
FIG. 4 is a lateral cross-sectional view on the line A—A of FIG. 3.

The trigger is retained in the housing 10 by means of the retaining member 18 which comprises a planar end cap 44, two spaced convex outer portions 46 engagable under the housing either side of the end recess 40 therein, and an upper end retainer strip 48 which, when the retaining member is inserted in the end of the housing, will restrain the trigger again movement axially outwardly of the housing recess 40. The retaining member 18 is itself secured to the housing by folding over the axial extremities of the housing either side of the recess 40 to overlie the end cap 44 of the retaining member as shown in the final assembly in FIG. 2 of the drawings.

Figure 5:
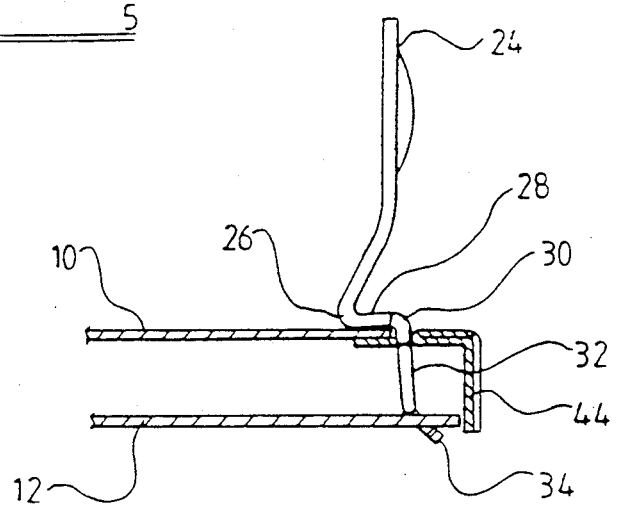
FIG. 5 is a longitudinal cross-sectional view of the end of the mechanism showing the trigger in its locked position.
Figure 6:
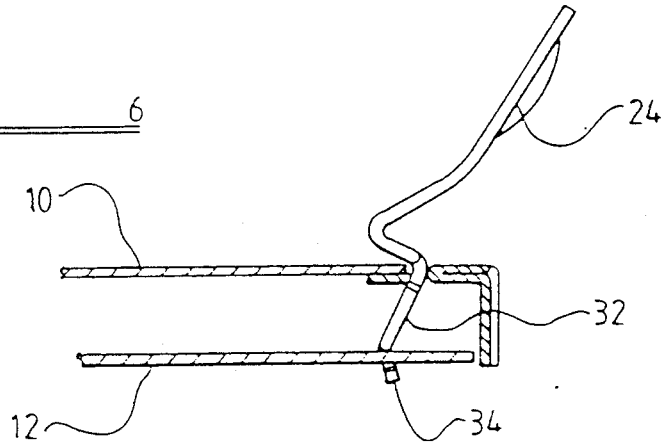
FIG. 6 is a similar longitudinal cross-sectional view showing the trigger in its unlocked position and with the blades carrying the half-rings in their closed position.

Turning now to FIGS. 5 to 7 of the drawings, the mechanism is shown in FIG. 5 with the blades 12 carrying the half-rings 14 in their closed position with the locking trigger 16 in its locked position wherein, with respect to the orientation shown in the drawing, the plane containing the locking arms 32 of the trigger is inclined to the vertical with the lower surfaces of the locking arms 32 bearing on the upper surfaces of the blades 12. The cranked transition 26 between the operating portion 24 of the trigger and the intermediate portion 28 bears on the upper surface of the housing 10. In this position it is impossible manually to pull the half-rings 14 apart to their fully open position since the locking arms 32 of the trigger prevent the blades 12 from moving. It will of course be possible to separate the abutting ends of the half-rings to a limited extent at a position remote from the locking trigger but as two such locking triggers will generally be provided on such a mechanism, one at each end of the housing, it will to all intents and purposes be impossible to separate the opposed pairs of half-rings.

In FIG. 6 the trigger 16 has been rotated in a clockwise direction through its over-centre position so that the plane of the locking arms 32 is inclined to the other side of the vertical from that shown in FIG. 5. In this unlocked position of the trigger it is loose within the housing, and the blades carrying the half-rings may be moved to the open position shown in FIG. 7 by grasping a pair of opposed half-rings and manually pulling them apart to cause the blades 12 to move to their open position with a toggle, or snap, action. Alternatively, the blades 12 may be moved to their open position by exerting further clockwise movement of the trigger 16 from the position shown in FIG. 6 whereby the laterally extending portions 34 of the trigger located beneath the blades will exert an upward force on the blades to cause them to move with a toggle action to their open position. In the open position, as shown in FIG. 7, the trigger lies relatively flat with its locking arms 32 trapped between the blades and the housing.

The blades carrying the half-rings may be returned to their closed position from the open position shown in FIG. 7 by rotating the trigger 16 in a counter-clockwise direction whereby the lower surfaces of the trigger locking arms 32 will bear on the upper surfaces of the blades 12 and cause them to move with a toggle action to the position shown in FIG. 6. Alternatively the half-rings may be closed manually by pressing them together in which case the blades 12, when moving to the position shown in FIG. 6 will bear downwardly on the upper surface of the laterally extending portions 34 of the trigger and cause it to move to the free unlocked position shown in FIG. 6. Subsequently the trigger 16 can be further rotated in a counter-clockwise direction with an over-centre action to the position shown in FIG. 5 in which the blades 12 and half-rings 14 are locked in the closed position.

Thus in accordance with the invention there is provided a simple construction of ring binder mechanism wherein the locking trigger 16 functions to lock the blades 12 and half-rings 14 in the closed position and also functions as a booster to move the blades and half-rings between their closed and open positions and vice versa. The trigger is formed of a single piece of metal in a relatively simple fabrication operation thereby leading to economies of cost in production as well as dispensing with the relative complexities of the pivot pin mechanisms of the prior art.

I claim:

1. A ring binder locking mechanism, comprising:

an elongated spring housing with a plurality of apertures and having a recess at an end thereof and having opposed edges which define said recess:

a pair of elongated blades each having a blade end portion, each of said blade end portions having an opposed edge facing each other and defining an axially extending recess between said opposed edges that is in alignment with said recess in the housing;

a plurality of half-rings mounted on and being movable with each of said blades between corresponding open and closed positions, said half-rings each extending through a respective one of said apertures in said housing, opposed ones of said half-rings each having an opposed end separated from each other in said open position, said opposed ends being in contact with each other in said closed position; and means for locking said half-rings in said closed position, said locking means including a trigger having laterally extending edges defining laterally extending locking arms and laterally extending portions said trigger being movable between an unlocked position, in which said locking arms are free between said blades and said housing, and a locked position, in which said locking arms bear on said blades for preventing said blades from moving to said open position, the lateral edges of said trigger further defining first and second pairs of grooves separated from each other by said locking arms, a groove of each pair being on opposite sides of said trigger, the inner edges of the blades at the recess in said blades being engaged in the first groove and the recess in said housing being engaged in said second groove.

2. A mechanism as in claim 1, further comprising means for retaining said trigger and said spring housing together, said retaining means including a retaining member into which is inserted end portions of said housing adjacent said recess.

3. A ring binder locking mechanism comprising:

an elongate spring housing having at least one recess at an end thereof and having opposed edges which define said at least one recess;

a pair of elongate blades each having inner and outer edges, said blades each extending within said housing in edge-to-edge relationship with one another, said outer edges being retained at opposed edges of said housing, said blades together having an end with at least one recess in alignment with said at least one recess in the housing;

a plurality of half-rings mounted on each blade each extending through an aperture in said housing, the half-rings on one blade cooperating with half-rings on the other blade and being movable with the blades between an open position in which the inner edges of the blades are located adjacent the housing and the ends of opposed half-rings are separated from one another and a closed position in which the inner edges of the blades are spaced from the housing and the ends of opposed half-rings are in contact with one another, the blades being movable between said open and closed positions with a toggle action against the resilience of the spring housing;

locking means for securing the half-rings in said closed position, said locking means comprising at least one locking trigger extending in one direction through the recess in said housing on the same side thereof as the half-rings and extending in the other direction between the housing and said blades, said trigger having lateral edges defining laterally extending locking arms adapted to bear on said housing, said locking trigger being movable, in the closed position of the half-rings and blades, with an over-center action between an unlocked position in which said locking arms are free between the blades and the housing and a locked position in which said locking arms bear on the blades and housing so as to prevent the blades from being moved to their open position, the lateral edges of said trigger also defining laterally extending portions engagable with respective ones of the inner edges of said blades at the recess in said blades, the lateral edges of said trigger further defining first and second pairs of grooves separated from each other by said locking arms, a groove of each pair being on opposite sides of said trigger, the inner edges of the blades at the recess in said blades being engaged in the first groove and the recess in said housing being engaged in said second groove.

4. A ring binder locking mechanism as claimed in claim 3 wherein the trigger is of one-piece construction comprising said locking arms, an operating portion located on the same side of the housing as the half-rings, and said laterally extending portions engagable with the blades on those sides thereof remote from the housing; said locking arms, said operating portion and said laterally extending portions being formed integral with one another.

5. A ring binder locking mechanism as claimed in claim 4 wherein said locking arms comprise a pair of co-planar arms each extending from a central portion of the trigger, each said arm having a lower edge engagable with one of said blades and an upper edge engagable with the housing.

6. A ring binder locking mechanism as claimed in claim 5 wherein said upper and lower edges of each arm are convergent towards one another in a direction extending away from said central portion of the trigger.

7. A ring binder locking mechanism as claimed in any one of claims 4 to 6 wherein the end portions of the blades are configured so that through the axially extending recess the trigger extends in such a manner that each of said blades is straddled by a respective one of said locking arms on a side adjacent the housing, and a respective one of said laterally extending portions on another side remote from the housing.

8. A ring binder locking mechanism as claimed in any one of claims 4 to 6 wherein the trigger is retained for movement between its locked and unlocked positions within the housing by a separate retaining member located within a respective end of the housing.

* * * * *